US005692560A

United States Patent [19]

Messant et al.

[11] Patent Number: 5,692,560

[45] Date of Patent: Dec. 2, 1997

[54] GROOVED TUBES FOR HEAT EXCHANGERS IN AIR CONDITIONING EQUIPMENT AND REFRIGERATING EQUIPMENT, AND CORRESPONDING EXCHANGERS

[75] Inventors: Michel Messant, Versailles; Veronique Pinet, Nanterre; Rene Predki, Landrichamps, all of France

[73] Assignee: Trefimetaux, Courbevoie, France

[21] Appl. No.: 549,808

[22] PCT Filed: Jun. 2, 1994

[86] PCT No.: PCT/FR94/00646

§ 371 Date: Jan. 5, 1996

§ 102(e) Date: Jan. 5, 1996

[87] PCT Pub. No.: WO94/29661

PCT Pub. Date: Dec. 22, 1994

[30] Foreign Application Priority Data

Jun. 7, 1993 [FR] France ..... 93 07021

[51] Int. Cl.[6] ..... F28F 1/32; F28F 1/40

[52] U.S. Cl. ..... 165/151; 165/184; 165/DIG. 525

[58] Field of Search ..... 165/133, 184, 165/DIG. 515, DIG. 525, 151; 29/890.046, 890.047

[56] References Cited

U.S. PATENT DOCUMENTS

| | | | |
|---|---|---|---|
| 4,658,892 | 4/1987 | Shinohara et al. | 165/133 |
| 4,660,630 | 4/1987 | Cunningham et al. | 165/133 |
| 5,010,643 | 4/1991 | Zohler | 29/890.048 |

FOREIGN PATENT DOCUMENTS

| | | | |
|---|---|---|---|
| 57-175896 | 10/1982 | Japan | 165/133 |
| 4-116391 | 4/1992 | Japan | 165/133 |

*Primary Examiner*—Allen J. Flanigan

*Attorney, Agent, or Firm*—Dennison, Meserole, Pollack & Scheiner

[57] ABSTRACT

Tube (1) internally grooved by helicoidal ribs (2) having a helix angle of 5° to 50°, an apex angle (alpha) of 30° to 60°. The tube is characterized in that the ribs (2) form a periodic profile comprising at least two ribs of different heights, one designated high (2*h*) of a height Hh, and the other designated low (2*b*) of a height Hb, with a ratio Hb/Hh of 0.40 to 0.97, each high rib being bordered by a flat-bottomed groove (3).

15 Claims, 7 Drawing Sheets

GROOVED TUBES FOR HEAT EXCHANGERS IN AIR CONDITIONING EQUIPMENT AND REFRIGERATING EQUIPMENT, AND CORRESPONDING EXCHANGERS

BACKGROUND OF THE INVENTION

The invention is concerned with tubes which are used for manufacturing heat exchangers in air conditioning equipment and refrigerating equipment, or for any other heating or cooling application, the tubes helping exchange heat between a fluid circulating in the tubes and the atmosphere circulating in said exchangers.

The invention is also concerned with said exchangers which usually comprise an assembly of copper, aluminium or steel tubes, usually in the form of pins (straight portions+ bends), and plates known as vanes, made of copper or aluminium, in thermal contact with said tubes, usually being perpendicular to said straight portions of the tubes and offering a large surface area for exchange with said atmosphere.

A very large number of variants of tubes, usually copper and copper alloy tubes, are already known, and means for improving heat exchange between the fluid circulating in the tube and the external atmosphere.

To illustrate these variants, it is possible to cite U.S. Pat. No. 4 480 684 and European Patent Application EP-A-148 609 which describe internally grooved tubes.

In U.S. Pat. No. 4 480 684, the grooves are characterised by a combination of the following features:

- spiral grooves with a helix angle relative to the tube axis of between 16° and 35°,
- grooves which are between 0.1 and 0.6 mm in depth,
- grooves with a pitch of between 0.2 and 0.6 mm,
- grooves of "V"-shaped section and with an angle of between 50° and 100°.

FIGS. 2 and 6 of that patent illustrate respectively an exchanger and a profile portion of the tube along a section which is perpendicular to the tube axis, showing "V"-shaped grooves separated by "V"-shaped ribs of the same angle, termed the apex angle (alpha).

European Application EP-A-148 609 also describes grooved tubes whose helical grooves are trapezoidal in section and whose ribs are triangular in section, which tubes are characterised by a combination of the following features:

- the ratio of the depth H of these grooves—or the height H of the ribs—to the internal diameter Di of the tube is between 0.02 and 0.03,
- the helix angle of these grooves is between 7° and 30°,
- the ratio of the transverse section S of the groove in relation to the depth H is between 0.15 and 0.40 mm,
- the apex angle of a rib is between 30° and 60°.

The skilled person has long been aware of the importance of grooved tubes in increasing heat exchange between a fluid circulating inside the tube and the tube itself.

The skilled person knows that in the case of a typical copper tube of external diameter 9.52 mm it is preferable to have a sufficient number (45 to 65) of helical ribs/grooves (with a helix angle of between 10° and 30°).

However, despite the fact that these features would seem to result from the skilled person analysing the prior art, with respect to many other features relating to the actual form of the ribs and grooves, the prior art does not give a unified picture, a homogeneous teaching, to which the skilled person could turn in order to be certain of obtaining a high performance exchanger tube.

Moreover, when working on realising compact batteries where there is improved thermal contact between tubes and vanes, the Applicant used per se known features to bend prior art grooved tubes and to crimp them with vanes, typically using a mandrel which went around inside the tube so as to cause the tube to expand slightly against the edge of the ends of the vanes, and to thus obtain excellent thermal contact, without the call for costly soldering or brazing techniques.

On examining sections of crimped tubes (standard tube with 60 "V"-shaped ribs), the Applicant noted that ribs became crushed which meant that there was a significant reduction in the depth H of the section S of the groove

| | before crimping | after crimping |
|---|---|---|
| H | 0.20 mm | 0.13 mm |
| S | 0.060 $mm^2$ | 0.024 $mm^2$ (−60%) |

As far as the heat exchange was concerned between the fluid circulating in the tube and the tube itself, the measurements taken as comparisons on tube portions before and after crimping confirmed that performance deteriorated after crimping due to a 60% reduction in the section S.

Thus, the Applicant came to the conclusion that it would only be useful to deal with and optimise the performance of a tube if consideration was also taken of the deformation of the ribs/grooves which could happen during assembly of the tubes and vanes.

Therefore, the Applicant looked fop an optimised groove/rib profile taking into consideration the crimping operation and thus permitting the harmful effects of crimping to be limited, but nonetheless being beneficial in terms of the heat exchange between the tube and vanes and which constitutes an economical assembly technique.

SUMMARY OF THE INVENTION

The tube which is the first object of the invention and which is intended for the manufacture of heat exchangers by said tube being crimped with vanes has an external diameter De of between 3 and 30 mm and is grooved internally with n helical ribs (where n is between 35 and 90) with a helix angle of between 5° and 50°, an apex angle (alpha) of between 30° and 60°, and is characterised in that said ribs form a periodic profile comprising at least two ribs of different height, the one known as the "tall" one being of a height Hh, and the other one known as the "low" one being of a height Hb, with a Hb/Hh ratio of between 0.40 and 0.97, each "tall" rib being disposed between two flat-bottomed grooves.

The periodic profile is the term given to the succession of ribs and vanes which is reproduced uniformly at each pitch p.

Tests carried out by the Applicant have revealed that a Hb/Hh ratio, even only slightly less than 1, is already sufficient to give a significant effect. However, it is preferable if the Hb/Hh ratio is between 0.6 and 0.95, the heat exchange capacity of the tube after the vanes have been crimped decreasing beyond these limits, and decreasing still further beyond the limits 0.40–0.97.

The solution found generically comprises two basic features by way of a periodic profile, on the one hand, which comprises at least two ribs of different height (Hh and Hb), and, on the other hand, by way of each "tall" rib being disposed between two flat-bottomed grooves with a section of area S.

These are the two elements essential to the invention in order that after the tubes have been crimped with grooves and vanes tubes may be produced which have flat-bottomed grooves with a section of area S'<S, but being of a sufficient value to give efficient heat exchange.

Unexpectedly, the Applicant noted that the periodic profile according to the invention was advantageous with respect to the heat exchange capacity after the tubes (straight parts and bent parts) and vanes had been assembled by the crimping operation.

In fact, the way in which the ribs are differentiated by their height which results in them being given different functions during the crimping operation (the "tall" ribs having a "protective" or "sacrificial" function, and the "low" ribs being "protected") could not predict the results obtained according to the invention.

Thus, the Applicant was not content to optimise the internal configuration of the tubes which were themselves considered in terms of their heat exchanging properties (with evaporation or condensation). Rather, the Applicant took into consideration both the manufacture of the tubes themselves and the manufacture of the corresponding exchangers by assembling the tubes and vanes using a crimping mandrel. It is within this scope that the invention constitutes an effective solution to the problem posed.

DESCRIPTION OF THE PREFERRED EMBODIMENTS

Figure 1A:
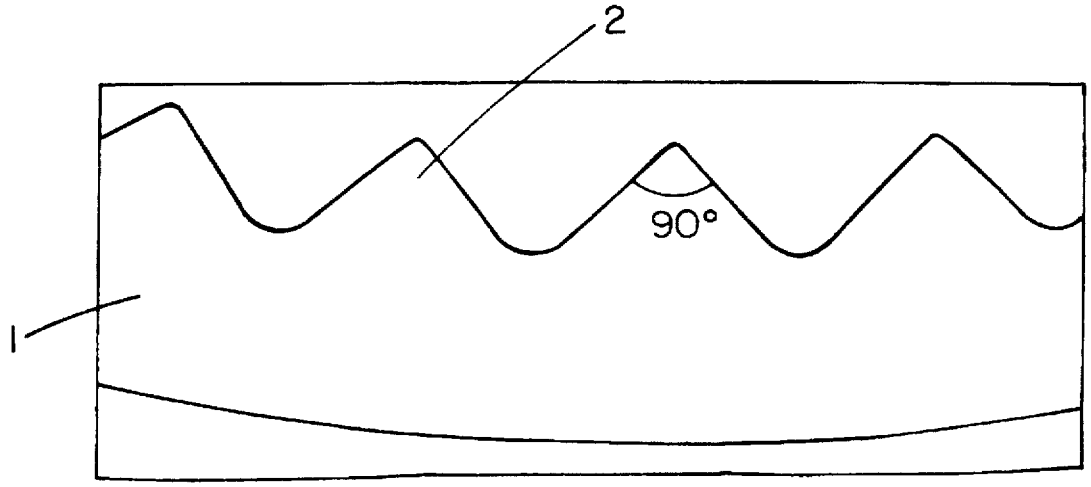
FIGS. 1*a* and 1*b* are cross-sectional views through a portion of a grooved tube according to the prior art.
Figure 1B:
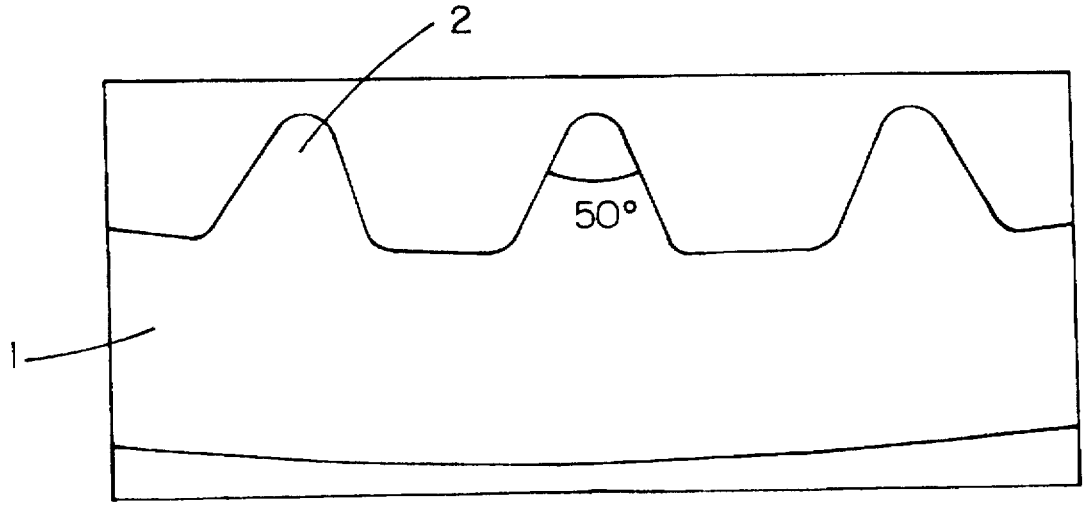

FIGS. 1*a* and 1*b* show part of a cross-section through a grooved tube (1) according to the prior art, the section being perpendicular to the tube axis, the light part of the photo on the black background corresponding to the tube.

In FIG. 1*a*, the tube (1) has ribs (2) which are triangular in section and with an apex angle close to 90°, forming grooves of substantially triangular section between them.

In FIG. 1*b*, the ribs (2) which are substantially triangular in section and with an apex angle close to 50° form grooves of trapezoidal section between them.

Figure 2:
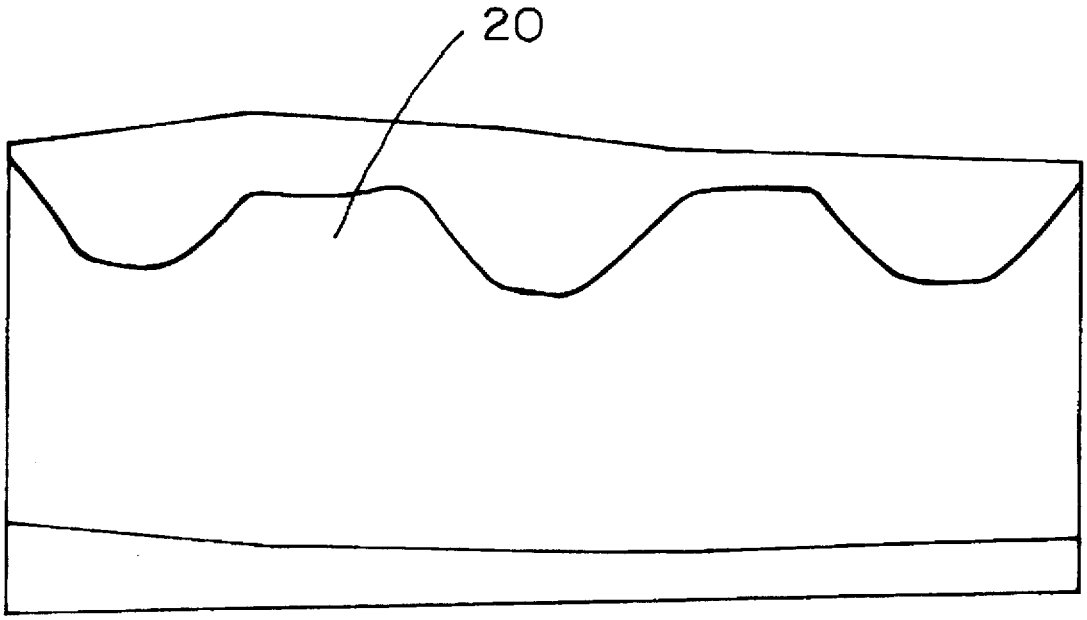
FIG. 2 shows the tube of FIG. 1*b* after crimping.

FIG. 2 relates to the prior art and corresponds to FIG. 1*b*, after crimping of the tube with vanes during fitment of a battery, and shows flattened and deformed ribs (20), the light part of the photo on the black background corresponding to the tube.

Figure 3A:
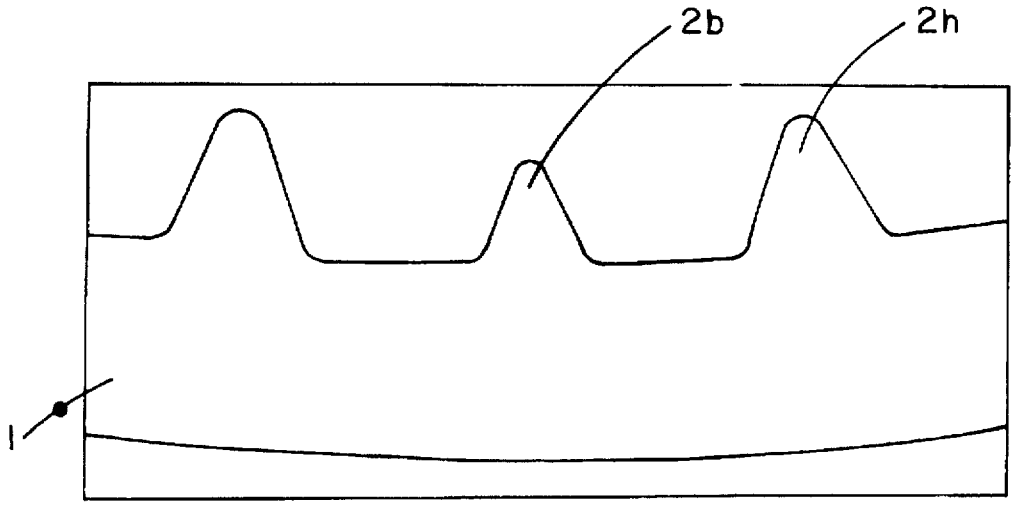
FIG. 3*a* is a portion of a cross-section through a grooved tube according to the invention.

FIG. 3*a* shows part of a cross-section through a grooved tube (1) according to the invention, the section being perpendicular to the tube axis, the light part of the photo on the black background corresponding to the tube. It is formed by alternate "tall" ribs (2*h*) and "low" ribs (2*b*).

Figure 3B:
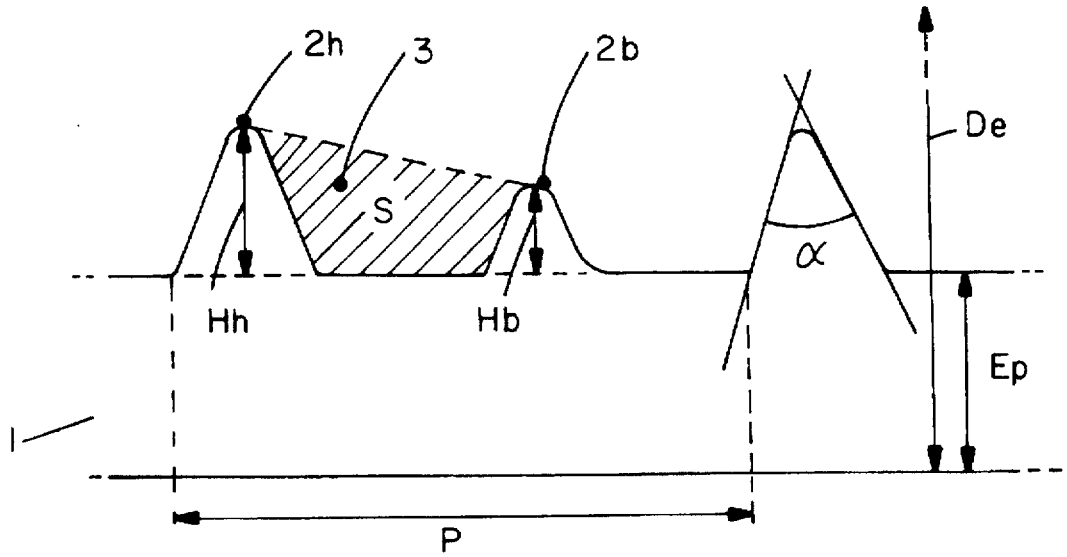
FIG. 3*b* is a schematic illustration of FIG. 3*a;*

FIG. 3*b* is the illustration corresponding to the photo 3*a* indicating the two types of rib (2*h* and 2*b*) of height Hh and Hb respectively, the sections of the grooves (3) having an area S, the external diameter De and Lube thickness Ep (thickness at bottom of groove).

The pitch p of said periodic profile constituted by the succession: "tall" rib (2*h*)/flat-bottomed groove (3)/"low" rib (2*b*)/flat-bottomed groove (3)/etc. . .

The profile can be symbolised by "h/b" where h denotes a "tall" rib and b denotes a "low" rib, if the description is restricted to ribs.

Figure 4A:
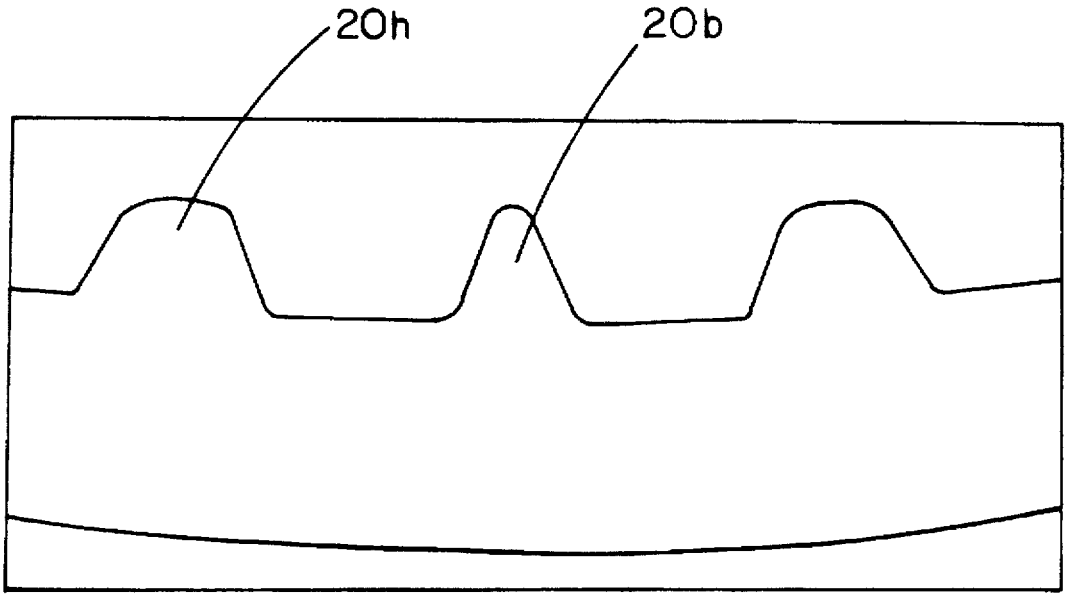
FIGS. 4*a* and 4*b* show the tube of FIGS. 3*a* and 3*b* after crimping.
Figure 4B:
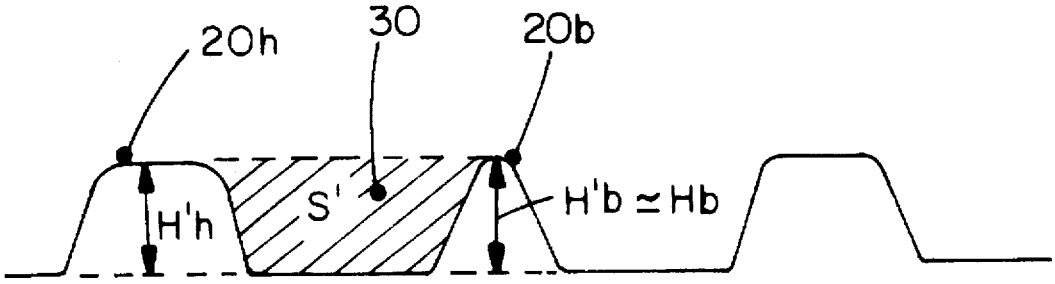

FIGS. 4*a* and 4*b* correspond to FIGS. 3*a* and 3*b*, but after the vanes and tube have been crimped. The rib (2*h*) (before crimping) has become, after crimping), the trapezoidal rib (20*h*) of height Hh', with Hh'<Hh, and similarly the rib denoted by the reference numeral (20*b*) corresponds to the initial rib (2*b*), the crimping operation having scarcely altered it (Hb'=Hb).

FIG. 4*b* shows the now groove (30) whose section has an area S'<S.

Figure 5A:
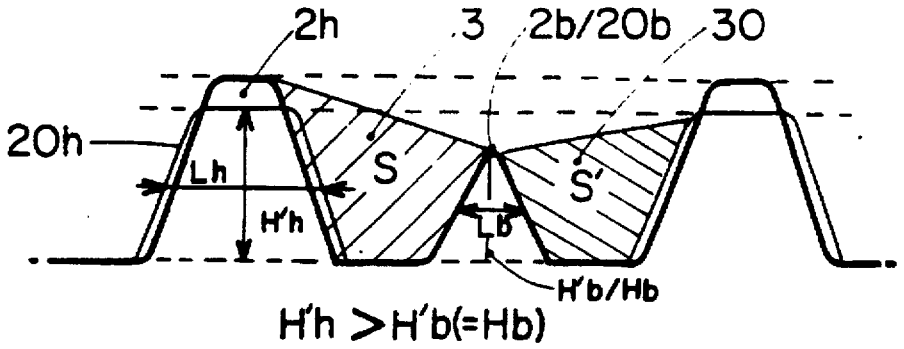
FIGS. 5*a*, 5*b* and 5*c* are schematic illustrations of tubes according to the invention.
Figure 5B:
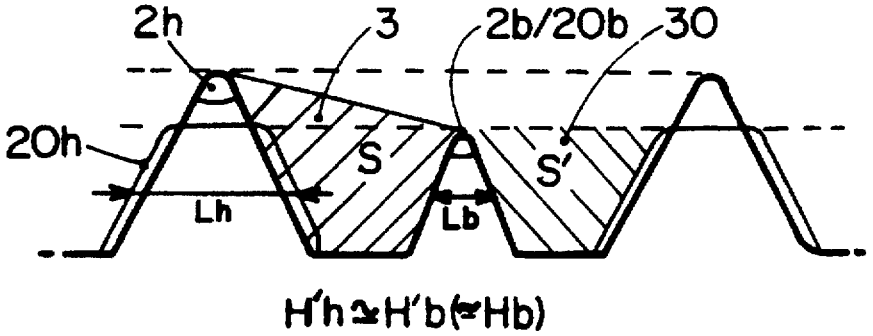
Figure 5C:
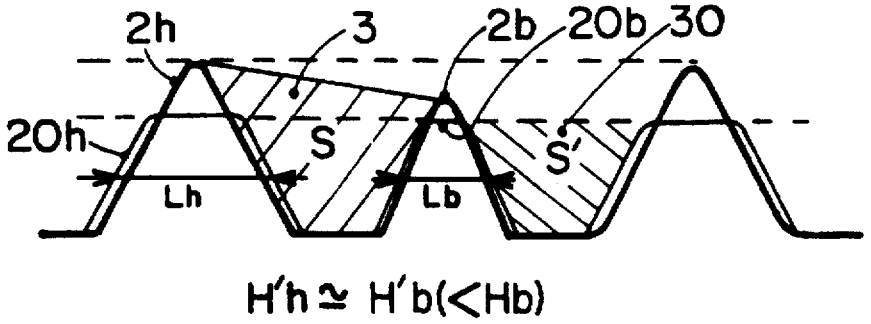

FIGS. 5*a* to 5*c* which are similar to FIG. 4*b* show different features of the invention. The same drawings show the profile of the ribs (2*h*) and (2*b*) before crimping (in thick lines) and the profile of the ribs (20*h*) and (20*b*) after crimping (in Fine lines) with the corresponding width Lh and Lb at mid-height, and also the areas S and S' of the sections of the grooves (3) and (30) before and after crimping respectively.

In FIG. 5*a*, the rib (2*h*) is trapezoidal, and after crimping H'h>H'b with H'b=Hb.

In FIG. 5*b*, the rib (2*h*) (apex angle of 50°) is triangular, and the rib (2*b*) (apex angle 30°) is also triangular.

After crimping, H'h is close to H'b, with H'b=Hb.

In FIG. 5*c*, the ribs (2*h*) and (2*b*) are triangular.

After crimping, H'h is close to H'b and H'b<Hb.

Figure 6A:
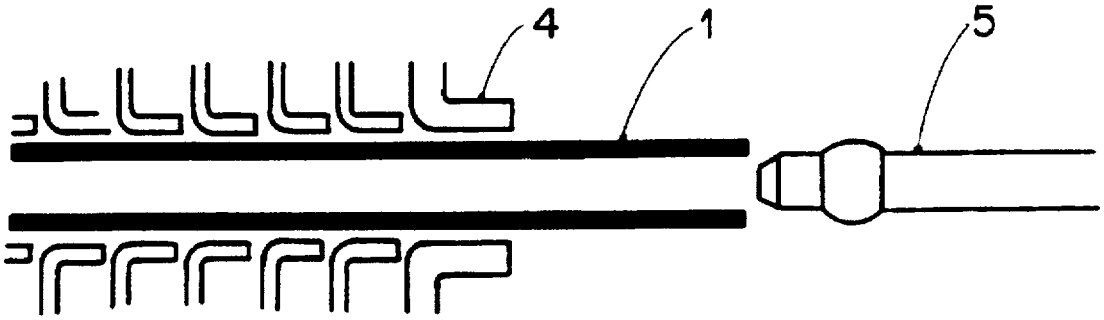
FIGS. 6*a* and 6*b* are cross-sectional views along a longitudinal axis of a grooved tube.
Figure 6B:
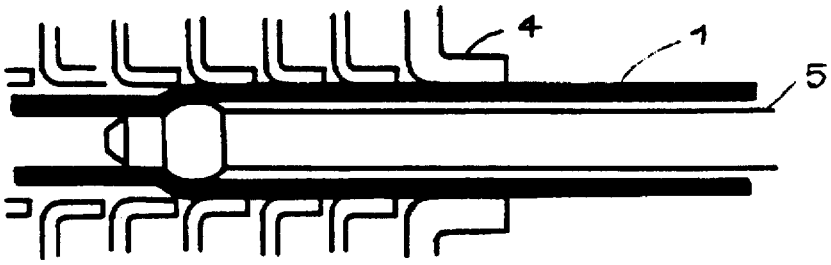

FIGS. 6*a* and 6*b* show sectional views along the axis of the grooved tube (1), of the crimping of vanes (4) by means of a mandrel (5), before the start of the crimping operation and during the crimping operation respectively.

Figure 7A:
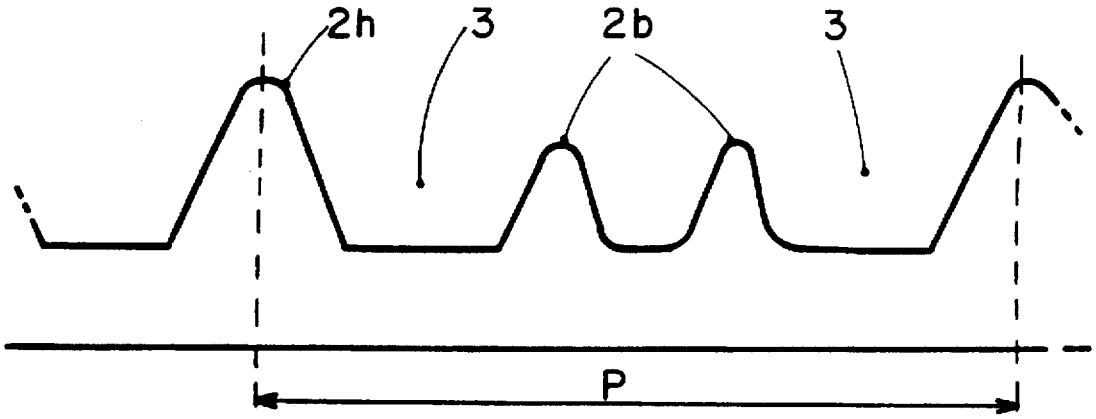
FIG. 7*a* and 7*b* are schematic diagrams of tubes according to the invention.
Figure 7B:
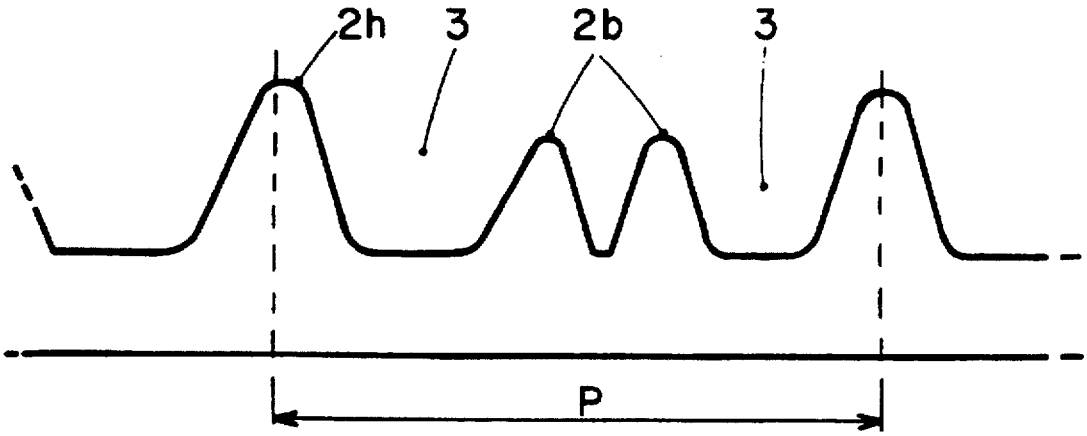

FIGS. 7*a* and 7*b* illustrate different profiles according to the invention.

These drawings represent a h/b/b type profile with the arrangements defined in FIG. 3*b*, with a flat-bottomed trapezoidal groove being disposed between the two "low" ribs (2*b*) in the case of FIG. 7*a*, and a triangular rib in the case of FIG. 7*b*. In both cases, each "high" rib (2*h*) is disposed between two flat-bottomed grooves (3).

Preferably, said periodic profile comprises the alternation, symbolised by h/b, of a "tall" rib (2*h*) and a "low" rib (2*b*), as shown in FIGS. 3*a* and 3*b*, or the succession, symbolised by h/b/b, of one "tall" rib and two "low" ribs, as shown in FIGS. 7*a* and 7*b*.

Of the profiles h/b and h/b/b, the profile h/b is preferred with an alternation of "tall" ribs (2*h*) and "low" ribs (2*b*) which form flat-bottomed grooves (3) between them.

The invention is used with tubes which have an external diameter De which can vary greatly between 3 and 30 mm. The height Hh of the "tall" ribs will vary with De, but will not necessarily be proportional to it.

Generally speaking, in order to maintain optimum efficiency of the grooved tubes after crimping, the Hh/De ratio must be between 0.003 and 0 05, preferably between 0.015 and 0.04.

According to one feature of the invention, said "tall" rib (2*h*) is substantially triangular in section and of height Hh.

As illustrated in FIGS. 3*a* and 3*b*, the term, "substantially triangular section" means a section where the vertex angle is relatively pounded, as shown, in particular, in FIG. 3*a* which is a cross-sectional view of a real tube (that described in the example) obtained from a photograph.

According to another feature, said "tall" rib (2*h*) is substantially trapezoidal in section and is of the height Hh, as shown in FIG. 5*a*.

Preferably, said "low" rib (2*b*) is substantially triangular in section and is of height Hb, as can be seen in FIGS. 3*a* and 3*b*, and that stated hereinabove with regard to the meaning of the expression, "substantially triangular" is also applicable here.

According to the invention, it is advantageous to select tubes where the flat-bottomed, non-trapezoidal (since Hh>Hb) grooves (3) have a section of area S of between 0.020 and 0.15 $mm^2$ preferably between 0.060 and 0.15 $mm^2$ in the case of a tube with an external diameter De of at least 7.93 mm, preferably between 0.020 and 0.070 $mm^2$ in the case of a tube with an external diameter De lower than 7.93 mm. These values are those obtained typically for:

- a height Hb of between 0.10 and 0.20 mm,
- a height Hh of between 0.20 and 0.30 mm,
- a flat bottom (substantially flat, not taking into account the curvature of the tube) of length 0.10 to 0.20 mm, the pitch (pitch=sum of the length of the flat bottom, plus half the base of the "tall" rib, plus half the base of the "low" rib) usually being between 0.40 and 0.50 mm for a standard tube of internal diameter (at the bottom of the groove) in the order of 8.8 mm.

In the case of a tube of smaller diameter (7 mm, for example), the heights Hb and Hh, and the height Hh, in particular, would be reduced (see Examples 5 and 6).

With regard to the area S, its lower limit results from the need to have sufficiently high heat exchange between the fluid circulating inside the tube and the external atmosphere.

On the other hand, the upper limit of the area S results, first of all, from geometrical considerations, taking into account customary tube sizes and the number n of ribs (2*h*, 2*b*).

A second object of the invention is the heat exchanger formed by crimping vanes and grooved tubes, wherein, after a crimping mandrel has passed inside said tube to assemble said vanes and tubes by the tube expanding due to the action of the mandrel, the ribs form a periodic profile which comprises at least two ribs of different width, the one known as the "wide" rib (2O*h*) being trapezoidal in section and of large width Lh at mid-height, and the other one known as the "narrow" rib (2O*b*) being triangular or trapezoidal in section and being of small width Lb at mid-height, with a (Lh-Lb)/De ratio which is at least equal to 0.003, the value of Lh-Lb usually being at least equal to 0.03 mm for a tube of external diameter 9.52 mm.

FIGS. 5*a* to 5*c* show the profile of ribs and grooves before and after crimping: the "tall" rib (2*h*) before crimping becomes the rib (20*h*) of smaller height after crimping, and the "low" rib (2*b*) becomes the rib (20*b*) after crimping—symmetric designation—but it is not greatly changed by the crimping operation (it is slightly flattened in FIG. 5*c*, but unchanged in FIGS. 5*a* and 5*c*).

In the particular case where said "low" groove (2*b*) is relatively tall, or, which basically results in the same thing, when Hb-Hb is low, after crimping, said "wide" rib and said "narrow" rib are substantially the same height (H'h=H'b) and said section of area S' of said flat-bottomed grooves (30) is trapezoidal.

A reduction is still to be seen in the area S of the section of the grooves (3), which area S becomes S'<S after crimping. However, this reduction is limited by virtue of the invention. Usually, the section S' of said flat-bottomed grooves (30) has a surface of between 0.015 and 0.060 mm, preferably between 0.35 and 0.60 for a tube with an external diameter of 9.52 mm.

EXAMPLES

All the tubes described in the examples have been manufactured by way of a per se known process employing a floating mandrel with external grooves (the grooves and ribs on the outer surface of the mandrel corresponding to the ribs and grooves which are to be obtained on the inner surface of the tubes), the process being of the kind described in U.S. Pat. No. 4 373 366.

Examples 1, 3, 5, 6, 8 and 9 are in accordance With the invention with a tube profile according to FIG. 3*a* and 3*b*. Examples 2, 4 and 7 are examples given by way of comparison in accordance with the prior art.

In all the examples, the tubes have been made from copper (Cub1-DHP) in accordance with standard NFA 51123 (=ASTM B68 and 280).

EXAMPLES 1 and 2

Internally grooved tubes were manufactured with an external diameter De of 9.52 mm and a thickness Ep at the bottom of the grooves of 0.30 mm.

| OTHER CHARACTERISTICS of the tubes manufactured | EXAMPLE 1 (invention) | EXAMPLE 2 (prior art) |
|---|---|---|
| Height of rib (tall rib for example 1) | 0.23 mm | 0.20 mm |
| Height of adjacent rib (low rib for ex. 1) | 0.16 mm | 0.20 mm |
| Apex angle of ribs (alpha) | 40" | 50" |
| Helix angle (beta) | 18" | 18" |
| Number n of ribs | 60 | 60 |
| Area S of a section of a groove | 0.070 $mm^2$ | 0.060 $mm^2$ |

These types of tube were then fitted with vanes by crimping using a mandrel, as shown in FIGS. 6*a* and 6*b*.

Samples of crimped tubes were taken to examine the geometric characteristics of the internal ribs and grooves:

| CHARACTERISTICS after crimping | EXAMPLE 1 (invention) | EXAMPLE 2 (prior art) |
|---|---|---|
| Height of rib ("tall" (H'h) for ex. 1) | 0.20 mm | 0.13 mm |
| Height of adjacent rib ("low" (H'b) for ex. 1) | 0.16 mm | 0.13 mm |
| Width of rib at mid-height Lh (rib 20h for ex. 1) | 0.096 mm | 0.25 mm |
| Width of adjacent rib at mid-height Lb (rib 20b for ex. 1) | 0.048 mm | 0.25 mm |
| Area S' of a section of groove | 0.042 $mm^2$ | 0.024 $mm^2$ |

Finally, a comparative assessment was made of the performances of the tubes in Examples 1 and 2 before and after crimping by measuring the average exchange coefficient ($W/m^2.K$) with condensation (vapour content=50% and saturation temperature=30° C.), and with evaporation (vapour content=30% and saturation temperature=10° C.) of a standard chlorofluorocarbonated refrigerating liquid (Freon R22 (R)) at a mass rate of 160 kg/m$^2$.s.

The following values were found:

| | with evaporation | with condensation |
|---|---|---|
| Tube before crimping | | |
| * according to Example 1 | 9500 W/m$^2$ · K | 9400 W/m$^2$ · K |
| * according to Example 2 | 8500 W/m$^2$ · K | 9600 W/m$^2$ · K |
| Tubes after crimping | | |
| * according to Example 1 | 5700 W/m$^2$ · K | 5640 W/m$^2$ · K |
| * according to Example 2 | 3400 W/m$^2$ · K | 3840 W/m$^2$ · K |

By comparing these values it can be seen that even though the tubes according to the invention are only just slightly superior to the prior art tube taken as a comparison (with condensation and evaporation respectively), after crimping they are clearly superior to a prior art tube both with condensation and evaporation, and this shows the importance of the invention.

EXAMPLES 3 and 4

Internally grooved tubes were manufactured with an external diameter De of 7 mm and a thickness Ep at the bottom of the groove of 0.25 mm.

| OTHER CHARACTERISTICS of the tubes manufactured | EXAMPLE 3 (invention) | EXAMPLE 4 (prior art) |
|---|---|---|
| Height of rib (tall rib for example 3) | 0.18 mm | 0.18 mm |
| Height of adjacent rib (low rib for ex. 3) | 0.15 mm | 0.18 mm |
| Apex angle of ribs (alpha) | 40" | 40" |
| Helix angle (beta) | 18" | 18" |
| Number n of ribs | 44 | 50 |
| Area S of a section of a groove | 0.060 mm$^2$ | 0.053 mm$^2$ |

These types of tube were then provided with vanes by way of a crimping operation using a mandrel as shown in FIGS. 6*a* and 6*b*.

The tubes were tested before and after crimping vanes onto the tubes, and the same variations in performance as those noted between the tubes in Example 1 and those in Example 2 were observed:

before crimping: performances close to the tubes according to Examples 3 and 4.

after crimping: better performance by the tubes according to Example 3 (invention) than by the tubes according to Example 4 (prior art).

As with Examples 1 and 2, with Examples 3 and 4 it is seen that the reduction in performance resulting from crimping the vanes on the tubes is less with the tubes according to the invention.

EXAMPLES 5, 6 and 7

In the case of Examples 5 and 7, internally grooved tubes were manufactured with an external diameter De of 9.52 mm and a thickness Ep at the bottom of the groove of 0.30 mm.

In the case of Example 6, internally grooved tubes were manufactured of external diameter De of 7.93 mm and a thickness Ep at the bottom of the groove of 0.25 mm.

| OTHER CHARACTERISTICS of the tubes manufactured | EXAMPLE 5 (invention) | EXAMPLE 6 (invention) | EXAMPLE 7 (prior art) |
|---|---|---|---|
| Height of rib (tall rib for Examples 5 and 6) | 0.23 mm | 0.18 mm | 0.20 mm |
| Height of adjacent rib (low rib for Ex. 5 and 6) | 0.16 mm | 0.15 mm | 0.20 mm |
| Apex angle of ribs (alpha) | 40" | 40" | 40" |
| Helix angle (beta) | 18" | 18" | 18" |
| Number n of ribs | 54 | 46 | 60 |
| Area S (section of groove) | 0.075 | 0.061 | 0.062 |

The losses in pressure (or losses of charge) were measured before and after crimping for a freon flow rate of 110 kg/m$^2$.s and a vapour content by mass of between 10 and 60%.

It was found that the loss of charge with the tubes in Examples 5 and 6 according to the invention was 15% less than with the tube in Example 7 before crimping, and was 13% less than with the tube in, Example 7 after crimping.

EXAMPLES 8, 9 and 10

Internally grooved tubes were manufactured with an external diameter De 12.70 mm and a thickness Ep at the bottom of the groove of 0.36 mm.

| OTHER CHARACTERISTICS of the tubes manufactured | EXAMPLE 8 (invention) | EXAMPLE 9 (invention) | EXAMPLE 10 (outside invention) |
|---|---|---|---|
| Height of rib (tall rib for examples 5 and 6) | 0.25 mm | 0.25 mm | 0.25 mm |
| Height of adjacent rib (low rib for ex. 5 and 6) | 0.22 mm | 0.22 mm | 0.25 mm |
| Apex angle of ribs | 50" | 50" | 50" |
| Helix angle (beta) | 18" | 30" | 0" |
| Number n of ribs | 65 | 65 | 65 |
| Area S (section of groove) | 0.089 | 0.089 | 0.082 |

The heat exchange coefficients (W/m$^2$.K) were calculated as a function of the helix angle beta (18° for the tube in test 8, 30° for the tube in test 9 and 0° for the tube in test 10) of the tubes after crimping.

The measurements were taken with condensation for various freon R22 flow rate values.

Results=value of heat exchange coefficient in W/m$^2$.K)

| Flow rate of freon in kg/s | Example 8 | Example 9 | Example 10 |
|---|---|---|---|
| 0.08 | 2000 | 3450 | 1750 |
| 0.10 | 2700 | 4300 | 2150 |
| 0.12 | 3500 | 4950 | 2500 |
| 0.14 | 4500 | 5600 | 3000 |
| 0.16 | 5000 | 6400 | 3500 |
| 0.18 | 5800 | 7300 | 4000 |
| 0.20 | 6550 | 8000 | 4450 |

These tests, and others carried out with a helix angle greater than 30°, revealed that even though the intention was to benefit in terms of the heat exchange coefficient, it was desirable to select a helix angle which was at least equal to 30°, and preferably between 30° and 50°, the speed of manufacture tending to decrease as the helix angle increased in size.

However, if the intention was to benefit in terms of the manufacturing speed, it was preferable to select a helix angle of between 5° and 30°.

The main advantage of the invention is therefore that of limiting the reduction in performance (exchange coefficient, in particular) when the tubes and vanes are being assembled by way of the crimping operation in order to manufacture a heat exchanger.

By virtue of the invention, and by virtue of the concept of the periodic profile with at least two ribs of different height, one of which "is sacrificed" during the crimping operation in order to "protect" the lower rib(s), it is therefore possible to use an economical and efficient assembly process whilst maintaining a high exchange capacity for the tube itself.

Moreover, since producing tubes according to the invention does not require means other than those customary for producing standard grooved tubes, the tube according to the invention does not work out to be any more expensive than the prior art tube.

The grooved tubes according to the invention are also advantageous in that they are particularly well suited for the manufacture of heat exchangers with crimped vanes, without losing their efficiency compared with prior art grooved tubes in applications which do not alter, or which only slightly alter, the grooves of the initial tubes, e.g. in exchangers with soldered or brazed vanes.

It is important to note, in particular, the very positive effect which the invention has on the loss of charge, as shown by Examples 5, 6 and 7.

A clear reduction to the diameter of the tube (external diameter=9.52 mm with the tubes in Example 5 and 7.93 mm with the tubes in Example 6) did not bring any significant increase in the loss of charge, contrary to what happened with prior art tubes.

Moreover, the reduction in loss of charge which was observed with the tubes according to the invention compared with prior art tubes is of great significance in practical terms in reducing the cost, bulk and weight of compressors used in refrigerating circuits.

What is claimed is:

1. A tube for the manufacture of a heat exchanger by crimping of vanes thereon, said tube having an external diameter De of between 3 and 30 mm and having an inner surface comprising a plurality of helical ribs thereon defining a helix angle of between 5° and 50° and each of said ribs defining an apex angle c of between 30° and 60°, said ribs forming a periodic profile comprising at least two ribs of different height above said inner surface, a first height Hh which is greater than a second height Hb, wherein Hb/Hh is between 0.40 and 0.97, each said rib of height Hh being disposed between two inner surface areas which are substantially flat.

2. A tube according to claim 1 wherein Hb/Hh is between 0.6 and 0.95.

3. A tube according to claims 1 wherein said Hh/De is between 0.003 and 0.05.

4. A tube according to claim 3 wherein said rib of height Hh is substantially triangular in section.

5. A tube according to claim 3 wherein said rib of height Hh is substantially trapezoidal in section.

6. A tube according to claim 1 wherein said rib of height Hh is substantially triangular in section.

7. A tube according to claim 1, wherein said periodic profile comprises a succession of a rib of height Hh alternating with a rib of height Hb, or a rib of height Hh alternating with two successive ribs of height Hb.

8. A tube according to claim 1, having a cross-section between consecutive ribs which is non-trapezoidal and has an area S between 0.020 and 0.15 $mm^2$.

9. A tube according to claim 7, wherein De is at least 7.93 mm and S is between 0.060 and 0.15 $mm^2$.

10. A tube according to claim 3, wherein Hh/De is between 0.015 and 0.04.

11. A tube for the manufacture of a heat exchanger by crimping of vanes thereon, said tube having an external diameter De of between 3 and 30 mm and having an inner surface comprising a plurality of helical ribs thereon defining a helix angle of between 5° and 50°, and each of said ribs defining an apex angle α of between 30° and 60°, said ribs forming a periodic profile comprising at least two ribs of different height above said inner surface, a first height Hh which is greater than a second height Hb, wherein Hb/Hh is between 0.40 and 0.97, said periodic profile comprising a rib of height Hh alternating with a rib of height Hb, said ribs being separated by inner surface areas which are substantially flat.

12. A heat exchanger formed by crimping vanes on a tube having an external diameter De of between 3 and 30 mm and having an inner surface comprising a plurality of helical ribs thereon defining a helix angle of between 5° and 50°, and each of said ribs defining an apex angle α of between 30° and 60°, said ribs forming a periodic profile comprising at least two ribs of different height above said inner surface, a first height Hh which is greater than a second height Hb, wherein Hb/Hh is between 0.40 and 0.97, each said rib of height Hh being disposed between two inner surface areas which are substantially flat, said vanes being crimped thereon by passing a crimping mandrel through the tube, the ribs being formed by the crimping of a periodic profile comprising at least two ribs of different width, a first rib of trapezoidal cross-section and width Lh at mid-height, and a second rib of triangular or trapezoidal cross-section and a lesser width Lb at mid-height, wherein (Lh-Lb)/De is at least 0.003.

13. A heat exchanger according to claim 12, wherein said periodic profile comprises a succession of a rib of width Lh and a rib of width Lb, or a rib of width Lh and two ribs of width Lb.

14. A heat exchanger according to claim 13, wherein said rib of width Lh and said rib of width Lb have substantially the same height, and are separated by a cross-sectional area S' which is trapezoidal.

15. A heat exchanger according to claim 12, wherein each said rib of width Lh is separated from an adjacent rib by a cross-sectional area S' of between 0.015 and 0.060 $mm^2$.

* * * * *